United States Patent [19]

Batzer et al.

[11] Patent Number: 4,559,787

[45] Date of Patent: Dec. 24, 1985

[54] VACUUM PUMP APPARATUS

[75] Inventors: Thomas H. Batzer, Livermore; Wayne R. Call, Tracy, both of Calif.

[73] Assignee: The United States of America as represented by the United States Department of Energy, Washington, D.C.

[21] Appl. No.: 678,148

[22] Filed: Dec. 4, 1984

[51] Int. Cl.[4] ..... F17C 7/02

[52] U.S. Cl. ..... 62/55.5; 55/269; 62/100; 62/268; 417/901

[58] Field of Search ..... 62/55.5, 100, 268; 417/901; 55/269

[56] References Cited

U.S. PATENT DOCUMENTS

| | | | |
|---|---|---|---|
| 2,668,424 | 2/1954 | Mueller | 62/55.5 |
| 2,757,840 | 8/1956 | Weissenberg et al. | 62/55.5 |
| 3,137,551 | 6/1964 | Mark | 62/55.5 |
| 3,175,373 | 3/1965 | Holkeboer et al. | 62/55.5 |
| 3,210,915 | 10/1965 | Kraus | 55/197 |
| 3,225,825 | 12/1965 | Lewis | 62/55.5 |
| 3,252,652 | 5/1966 | Trendelenburg et al. | 62/55.5 |
| 3,264,803 | 8/1966 | Read | 55/208 |
| 3,352,122 | 11/1967 | Rothenberg et al. | 62/55.5 |
| 3,574,950 | 4/1971 | Dantoni | 34/92 |
| 3,579,997 | 5/1971 | Rapinat | 62/55.5 |
| 3,579,998 | 5/1971 | Thibault et al. | 62/55.5 |
| 3,769,806 | 11/1973 | Boissin et al. | 62/55.5 |
| 4,072,025 | 2/1978 | Thibault | 62/55.5 |
| 4,148,196 | 4/1979 | French et al. | 62/55.5 |
| 4,198,829 | 4/1980 | Carle | 62/55.5 |
| 4,275,566 | 6/1981 | Bonn | 62/55.5 |
| 4,295,338 | 10/1981 | Welch | 62/55.5 |
| 4,336,690 | 6/1982 | Welch | 62/55.5 |
| 4,341,079 | 7/1982 | Bonn | 62/55.5 |
| 4,475,349 | 10/1984 | Batzer et al. | 62/55.5 |

OTHER PUBLICATIONS

Batzer, T. H. et al: "Mirror Fusion Vacuum Technology Developments", IEEE 10th Sym. on Fusion Engin., Phila., PA, 12/5–9/83.

Batzer, T. H. et al: "A Continuous Cryopumps for Steady State Mirror Fusion Reactors", Amer. Vac. Soc., 29th National Vacuum Sym., Balt., MD, 1982.

Damm, C. C. et al: "Preliminary Design of a Tandom-Mirror-Next-Step Facility", UCRL 53060, Lawrence Livermore Nat. Lab., 12/18/80.

*Primary Examiner*—Ronald C. Capossela

*Attorney, Agent, or Firm*—L. E. Carnahan; Roger S. Gaither; Judson R. Hightower

[57] ABSTRACT

An improved cryopumping apparatus which comprises a cryopumping space which may be alternately opened and closed from the surrounding area by moveable panels, trubular cryopanels within said cryopumping space through which a coolant such as liquid helium may be passed, and an apparatus for spraying liquid argon onto said cylindrical cryopanels in order to enhance the cryogenic entrapment of such low-z ions, atoms, and molecules as hydrogen and helium.

20 Claims, 4 Drawing Figures

VACUUM PUMP APPARATUS

BACKGROUND OF THE INVENTION

The invention described herein arose in the course of, or under, Contract No. W-7405-ENG-48 between the U.S. Department of Energy and the University of California.

The invention relates to an improved cryogenic pumping apparatus.

Cryogenic pumping has become widely applied in situations where ultra low pressures, in the order of $10^{-8}$ Torr or less, are required. (U.S. Pat. No. 3,210,915, issued Oct. 12, 1965 to T. Krasus; U.S. Pat. No. 3,579,997, issued May 25, 1971 to M. Rapinat, and U.S. Pat. No. 3,264,803, issued Aug. 9, 1966 to P. Read). Certain applications, such as the operation of a nuclear fusion reactor, require that such pressures not only be achieved, but also maintained over a sustained period of operation or experimentation. (See pp. 73–74, "Preliminary Design of a Tandem-Mirror-Next-Step-Facility" Damm et al UCRL-3060, Dec. 18, 1980, Lawrence Livermore National Laboratory).

Generally speaking, cryogenic pumping mechanisms (hereinafter also called "cryopumps") achieve extra high states of vacuum by "trapping" otherwise evasive stray gas particles by their condensation on highly thermal conductive surfaces, such as aluminum, cooled to temperatures less than 10° K. by coolants such as liquid helium.

In order to enhance the efficiency of cryopumping within the vacuum chamber, various adsorbent substances have been used, either as an integral part of the cryogenically cooled surface through coating, or by injection into a space which has already undergone significant evacuation pumping. U.S. Pat. No. 3,769,806, issued Nov. 6, 1973, to J. Boisson, et al describes one such arrangement. An evacuation chamber includes various cryogenic surfaces as well as a cryogenically cooled cylindrical cavity which is in communication with the vacuum chamber, but significantly less accessible as one end of the cylinder is sealed off and the other end is substantially blocked off. After a vacuum level of about $10^{-4}$ Torr is achieved through mechanical pumping and simple cryopumping, an adsorbent gas, such as Argon, is released as a spray into the described cylindrical chamber in such a manner as to quickly be confined within the cylinder and condense upon its inner walls, which have been subjected to particularly intensive flows of cryogenic coolant. This adsorbent gas, during its flight from release to condensation provides an additional medium for cryogenic condensation of stray gas molecules and is more effective than a stationary cryogenic panel or other surface. Such a system is, however, still limited by the amount of cryogenic surface within the chamber as it becomes covered by both the adsorbent gas and the trapped molecules.

Another means of enhancing cryogenic pumping efficiency comprises thermal shielding of the cryogenic surfaces from the line of sight of much of the surrounding space, wherein higher temperatures may exist in order to block off the resulting ambient heat. In U.S. Pat. No. 4,275,566, issued June 30, 1981, to J. Bonn the cryopumping apparatus consists of a series of parallel cryogenic surfaces cooled by liquid helium which are intended for the adsorbtion of gas molecules. Between these surfaces are placed shielding panels which are cooled by conduits of liquid nitrogen. These panels are designed to prevent any radiant heating from interfering with the adsorbtion of gas on the cryogenic panels. Bonn, however, like Boisson, is limited by the adsorbtion capacity of its cryogenic surfaces as shutdown of or intrusion into the vacuum vessel is required to clear off the cryogenic surfaces and resume cryopumping.

U.S. Pat. No. 4,475,349, issued Oct. 9, 1984, to T. Batzer, et al teaches a method of achieving continuous cryopumping by the use of movable louvres along the sides of the cryopump. In the open position, the cryogenic panels are fully in communication with the space of the vessel to be pumped and pumping is achieved. The louvres may then be rotated to the closed position and sealed off from the vacuum vessel and the liquid helium cut off from its refrigeration so that the cryogenic panels can be regenerated warming the panels to "boil off" the cryogenially trapped molecules. Regeneration can be accomplished without shutting down the operation of the vacuum vessel as the pump may be controlled from outside the vessel. By placing more than one such device within the vacuum vessel, cryopumping can be continuously conducted.

SUMMARY OF THE INVENTION

The present invention is designed to achieve continuous high efficiency cryopumping of a vacuum vessel by improving upon and combining in a novel way the above-described cryopumping methods. The invention consists of a continuous operation cryopump, with movable louvres as described above, with a high efficiency pumping apparatus.

The pumping apparatus includes three cryogenic tubes. They are constructed of a substance of high thermal conductivity, such as aluminum and their exterior surfaces are cryogenic condensing surfaces. Through their interior liquid or gaseous helium from two reservoirs can be made to flow, alternately promoting extreme cooling or allowing some warming. These tubes are positioned in a line near the center of a V shaped liquid nitrogen cooled panel, whose sides roughly surround the three tubes. These panels provide thermal shielding of the tubular cryogenic tubes. Rotatable louvres, as in Batzer, are attached to the ends of these V shaped panels.

Two shafts are positioned roughly between the tubes and out from them slightly on the side of the V shaped panel. These shafts are punctured towards the cryogenic tubes and so that an adsorbent gas, such as argon can by sprayed towards the cryogenic tubes. Connecting baffle plates, constructed of a suitable thermally conductive material as to act as additional cryogenic surfaces, are positioned to connect the cryogenic tubes opposite these spray tubes such that the gas sprayed out of them will travel either to a cryogenic tube or to one of the connecting baffle plates and condense thereon. The space within the pump chamber defined by the interior of the V shaped panels and the opposite side of the cryogenic tubes, joined by the metal baffle plates, then is the primary cryopump space.

When the louvres are in the fully open position, this primary cryopump space is in full communication with the atmosphere of the vacuum vessel. The helium cryotubes are cooled in order to gather condensate. Gaseous argon is sprayed toward the cryotubes and connecting baffles trapping particles en route and enhancing the efficiency of the cryogenic surfaces to trap condensed gas particles. The argon and the trapped condensate freezes on the cryosurfaces.

The louvres are then closed. Regeneration takes place as gaseous helium is forced through and warms the cryotubes, to about 80° K. causing the argon and trapped condensate to boil off of them. As this space is now sealed off from the rest of the vacuum vessel, this matter can be removed from the cryospace through a suitable exhaust without subjecting the vacuum vessel to significant back flow. When complete, the cryosurfaces are clean and prepared to renew pumping operations.

By placing several such devices within the vacuum vessel and properly timing their operation, it is possible to maintain continuous high-efficiency cryopumping within the vacuum vessel over a sustained period of operation.

It is an object of the invention to provide a high efficiency continuous opeation cryopump.

It is a further object of the invention to provide a high efficiency cryopump by utilizing a tubular shaped cryosurface, placing a greater density of refrigerant in close proximity to the targeted gas particles.

It is a further object of the invention to provide a cryopumping area which is protected from surrounding radiant heat while maintaining good gas flow communication with the vessel atmosphere.

It is a further object of the invention to provide enhanced cryopumping by the injection of an adsorbent gas through the pumping space to improve the ability of the cryosurface to condense and trap gas particles.

DETAILED DESCRIPTION OF THE INVENTION PREFERRED EMBODIMENT

Figure 1:
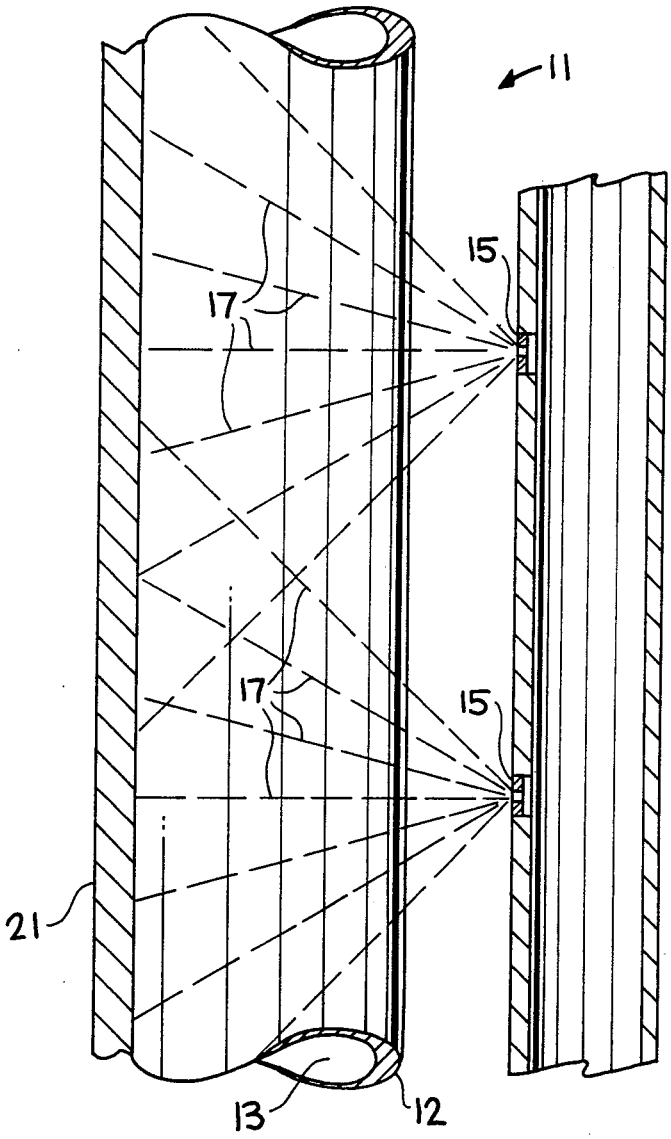
FIG. 1 is a side view of a single tubular cryogenic pumping panel, further demonstrating how the baffle is connected, and further showing the adsorbent spray rod.
Figure 2:
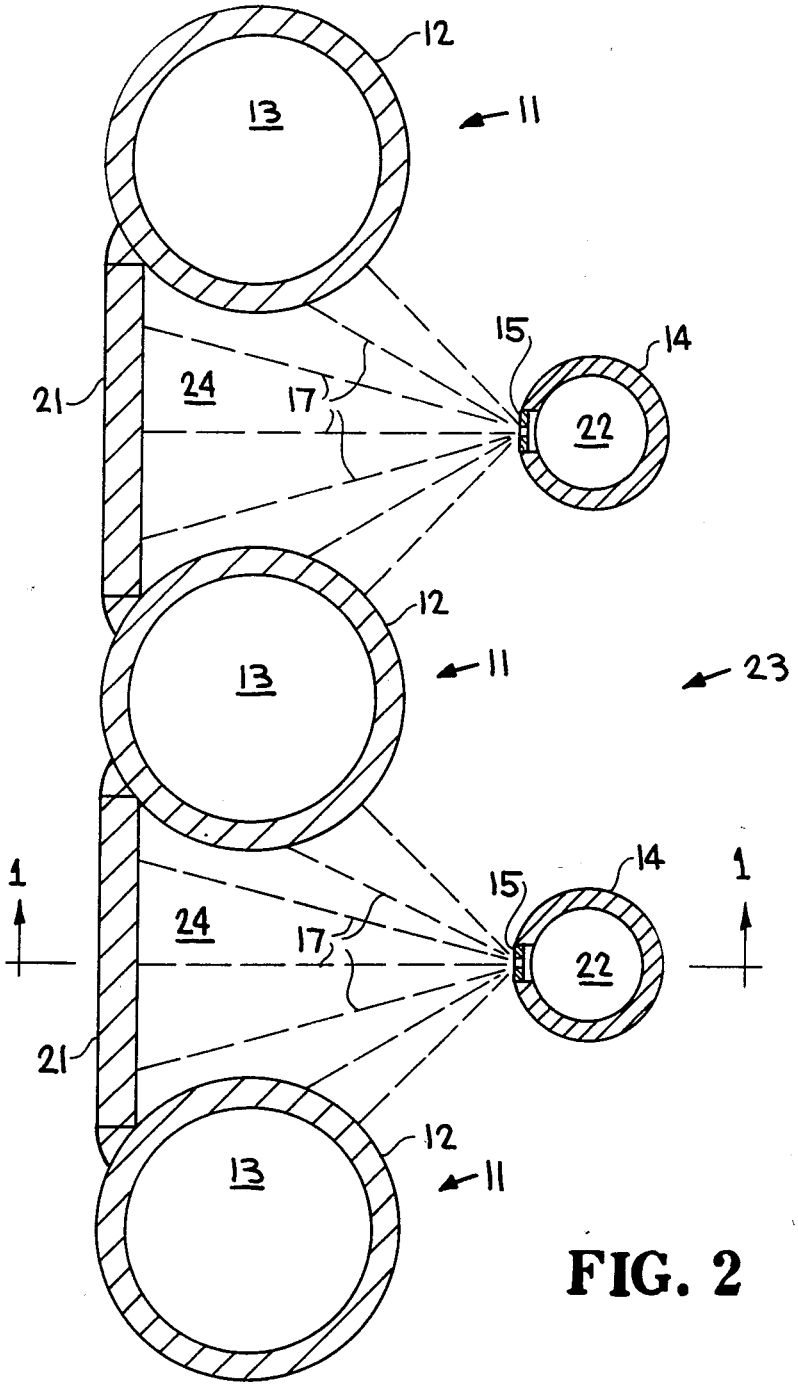
FIG. 2 is a view of the cross-section of the primary cryopumping area showing the arrangement of three tubular cryopump panels interconnected by baffles and two adsorbent spray rods.

Referring to FIG. 1, the basic tubular cryopump panel 11 is depicted. It provides a thermally conductive surface 12, such as aluminum, and an unobstructed conduit 13 connecting it to two helium reservoirs, 41 and 42 (FIG. 4) which are isolated outside of the vacuum vessel. A connecting baffle 21 (FIG. 2) extends between the tubular cryopump panels hereinafter called cryopanels. One hollowed spray tube 14 through whose interior 22, (FIG. 2) an absorbent material, such as argon, may be delivered to a series of spray jets 15, for spraying onto the tubular cryogenic pumping panels 11 is pictured in front of the tubular cryopanels 11 on the side opposite the connecting baffles 21.

The primary cryopumping area 23 (FIG. 2) consists of an array of three parallel tubular cryogenic pumping panels 11, lined up and suitably connected by the metallic baffles 21 such that two small cavities 24 are roughly enclosed. The adsorbent spray tubes 14 are lined up and oriented such that their spray jets 15 will spray adsorbent gas 17 into the roughly defined cavities 24 and onto either the exposed surface of the baffles 21 or the inner surface of the cryogenic pumping panels 12. The adsorbent gas 17 may then be sprayed exclusively within the roughly defined cavity 24.

Figure 3:
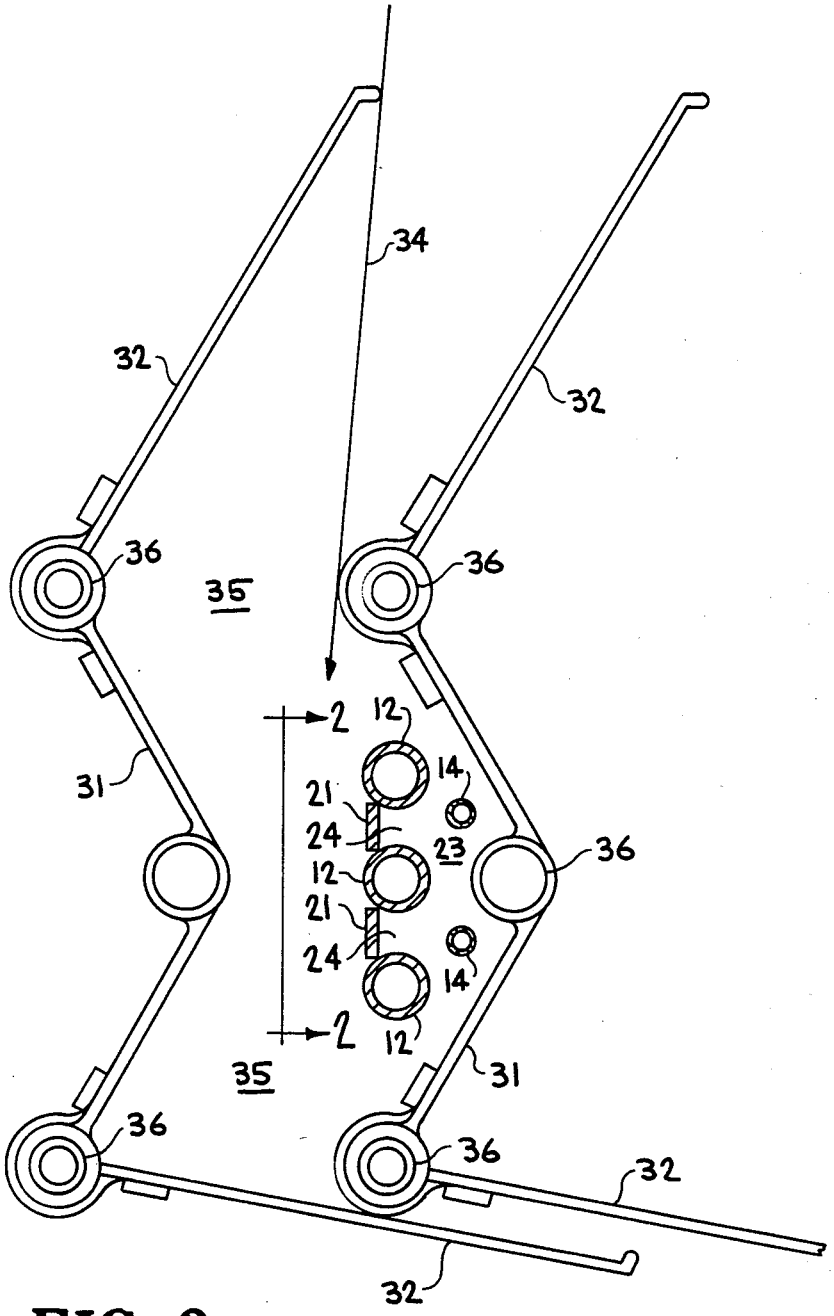
FIG. 3 is a view of the cross section a single cryopump cell demonstrating the overall primary cryopumping area of FIG. 2 within the overall pump cell along with the V shaped thermal radiation shields and attached movable louvres.

FIG. 3 depicts the V shaped thermal panel 31 and the rotatable louvres 32 located at either end. The upper half of the pump chamber, as depicted in FIG. 3, demonstrates the louvres 32 in the open position. It should be noted per the vector 34 that the orientation of the thermal panels 31, and rotatable louvres 32, when in the open position, prevents line of sight penetration by thermal radiation. The surfaces of both the louvres 32 and the V-shaped thermal panels 31 are blackened with a paint or material of high emissivity in order to absorb (rather than reflect) thermal radiation, but not impede deflection or passage of stray gas particles into the pump chamber 23, and primary cryopump area 24.

The rotatable louvre panels 32 at the bottom of FIG. 3 are depicted in the closed position. It should be noted that if both upper and lower louvres 32 are in the closed position the general area within the pump chamber 35 hereinafter called the cryopump cell 35, is isolated from the rest of the vessel to be pumped 51. At the apex of the V shaped thermal panels 31 another conduit passage 36 is provided down its entire length and into reservoirs (not depicted) of a refrigerant, such as liquid nitrogen, at each end in order to provide cooling to the panels. The rotatable louvres 32 are mounted on, and rotate about, an axis 36.

The rotatable louvres 32 located down each respective side of the cryopump cells 35 are interconnected with a levered interconnecting device (not depicted) such that they may all be rotated open or closed in unison.

Figure 4:
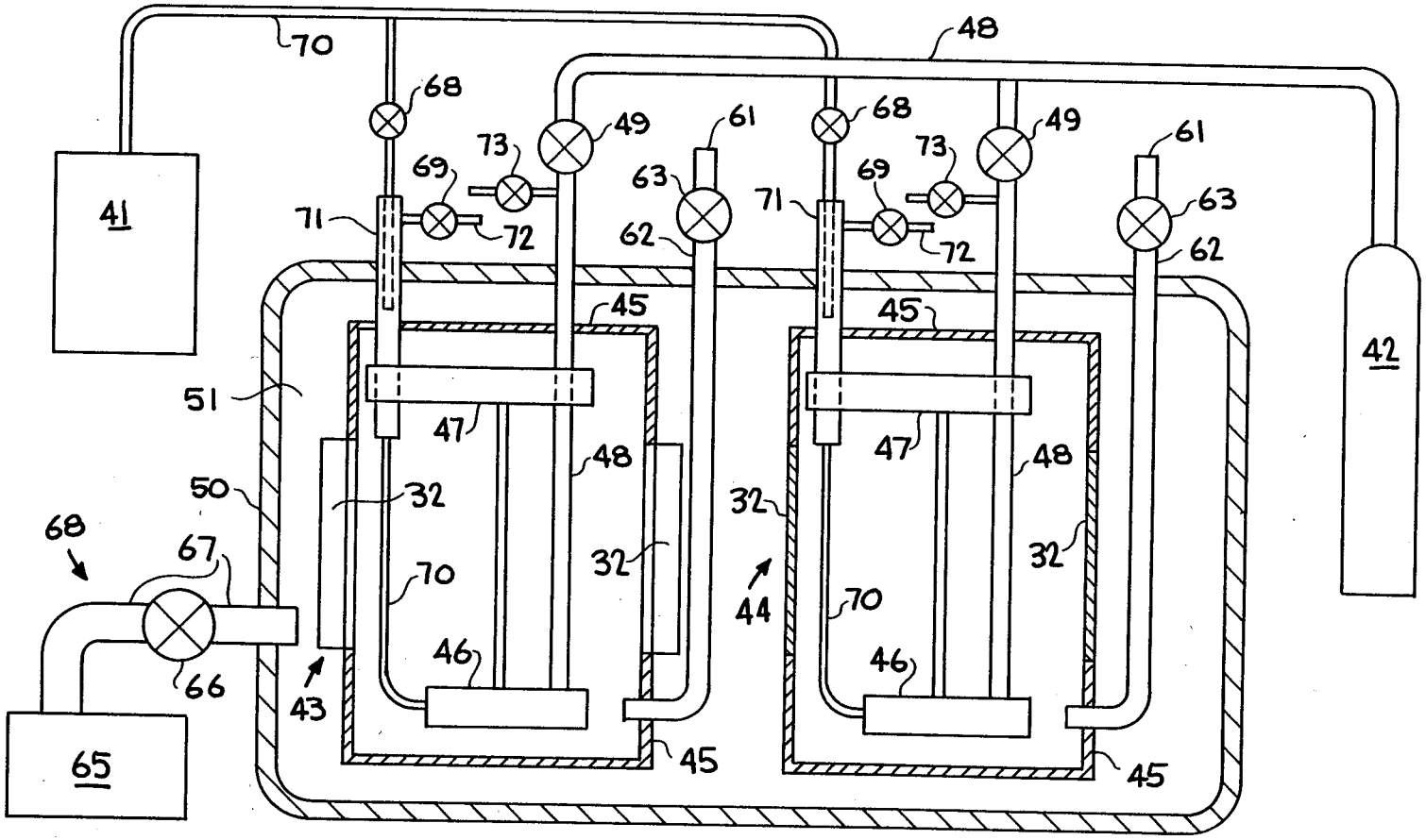
FIG. 4 is a schematic diagram of the cryogenic pumping apparatus, representing each of the functional parts of the cryopumping device.

At each end of the two schematically depicted cryopumping apparatus 43 and 44, of FIG. 4, are shrouding chambers 45 which allow passage of the cryopump tubes and conduits 11 and 13 between the helium reservoirs, 41, 42 and the conduits 22, and 36 (see FIGS. 2 and 3) between the liquid nitrogen reservoirs. (not shown), and the adsorbent material reservoirs (not shown) and the cryopumping area 35 (see FIG. 3), but are otherwise impervious to the passage of any form of gas liquid, or solid. Housed within the shrouding, 45 at either end, are upper 47 and lower 46 manifolds to allow for the even distribution of the liquid helium through the cryogenic tubes 11 and between the helium reservoirs 41 and 42.

Liquid helium reservoir 41 is in communication with the tubular cryogenic panels 11 through valve 68, duct 70 and the manifold 46. Duct 70 includes a coaxial section 71 which allows a backflow of helium, when pressures require or as desired, to escape the system through valve 69 and duct 72. Duct 70 passes through, without permitting direct fluid communication with, the interior of upper manifold 47 in an effort to maintain a stable, temperature at or near 4.2° K. in the liquid helium during cryopumping.

A valve 49 is situated in the duct 48 between the pressurized gaseous helium reservoir, 42 and the uppermost manifolds 47. This valve may be opened to allow communication between the pressurized gaseous reservoir 42 and the rest of the liquid helium system or closed to cause its isolation. Both helium reservoirs, 41 and 42, are located outside the vacuum vessel shell 50, which is also impervious to any form of gas.

An evacuation system generally indicated at 61 leads from the lower shroud 46 and through the vacuum vessel shell 50. It further comprises an evacuation duct 62, a valve 63, and a processing or holding tank (not depicted), wherein separation of the various trapped and adsorbent particles, such as the isotopes of hydrogen, helium, and argon may be conducted for recycling purposes. This system will be further in communication via conduit or duct 64 with a mechanical pumping means or other device (not depicted) to enhance the efficiency of evacuation of particles from within the primary pumping area to the outside of the vacuum vessel.

FIG. 4 also depicts a first stage pumping system 68 including pump, 65, valve 66, and duct 67 in which is in controlled communication with vacuum vessel 50. This may be a mechanical or other, pump and is intended to pump the vacuum vessel down to the pressure at which cryogenic pumping becomes necessary.

Within the vacuum vessel 51 schematically represented in FIG. 4 are two separate cryogenic pumping apparatus 43 and 44. The left system 43 is represented in the rotatable louvre 32 open position while the right system 44 depicts a cryogenic pumping apparatus is in the rotatable louvre panel 32 closed position. As depicted in the closed position 44 the thermal louvre panels 32 are perpendicular to the plane of the figure, and are not visible in cryogenic pumping apparatus 44.

OPERATION OF THE PREFERRED EMBODIMENT

Basic pumping mechanism 68 is used to mechanically or otherwise pump the vacuum vessel 50 down to a pressure suitable for cryogenic pumping (about $10^{-4}$ Torr or less) and then valve 66 is closed, sealing off the vacuum vessel from this system.

The operation of the described cryopump apparatus is as follows. All of the movable louvre panels 32, on at least one of several cryopumping apparatus, are placed in the open position (as in the upper half of FIG. 3 and schematically represented at 43 in FIG. 4). In this position, the cryopump cells 35 and the enclosed spaces 24 are in gas flow communication with the interior of the vacuum vessel 51. Valve 68 is opened and liquid helium is allowed to flow into the manifolds 46 and 47 through the conduits 13 of the three cryogenic tubes 11.

Both the V shaped thermal panels 31 are substantially cooled by the liquid nitrogen conduit 36, so that thermal radiation reaching the enclosed space 23 from the pump surroundings will be minimal. The tubular cryogenic panels 11, are thus brought down to a temperature of about 4.2° K. Stray gas particles coming into contact with any part of the cryogenic tubular panel surfaces 12 or baffle surfaces 23 thus cooled, will condense and be trapped upon them.

Argon gas is then forced, under pressure, at a temperature of about 130° K. through the conduit 22 in the spray rods 14 and out through the spray jets 15. The argon gas 17 is sprayed out in a path through the roughly enclosed area 24 and onto the exterior surfaces 12 of the tubular cryopanels or the facing surface of the baffles, (hereinafter called the cryosurfaces). While in transit between the spray jets 15 and the cryosurfaces 12 or 21, the argon gas particles 17 enhance the efficiency of the cryopump apparatus 43 by providing an additional medium for condensing the stray gas particles or molecules in the vacuum vessel. The argon gas 17, along with the trapped particles of gas are adsorbed and frozen onto the cryosurfaces 12 and 21. Once the cryosurfaces 12 and 21 are substantially covered with trapped gas particles and argon the regeneration phase is begun in order to clear them and evacuate the trapped, or pumped particles.

The rotatable louvres 32 are together rotated into the closed position as in the lower half of FIG. 3. A valve (not depicted) is closed in order to seal off the argon duct from backflow. The cryopump cell 35 is thus, by the closed louvres 32 and the shrouding 45 at either end of the apparatus, sealed off from the rest of the vacuum vessel. Valve 49 is opened and gaseous helium 42 is forced into the upper manifolds 47. The vent valve 69 is opened placing the helium conduits in communication with the outer atmosphere or to a suitable holding tank for recycling. The gaseous helium within the isolated cryopump cell 35 warms the interior of this cell 35, particulary on the cryosurfaces 12 and 21, to a sufficient temperature to "boil off" the frozen argon and stray particles trapped on the cryosurfaces 12 and baffles 21. Valve 63 will be opened and a mechanical pump or other device (not depicted), may be used to evacuate the argon and other trapped particles which have been liberated by this warming. When the cryosurfaces 12 and baffles 21 have been suitably cleared and the atmosphere within the isolated vacuum chamber 35 has been evacuated valve 63 will again be sealed off and the movable thermal panel louvres 32 reopened, restoring gas flow communication between the vacuum vessel 51 and cryopump cell 35. Valve 49 will then be closed, shutting off the gaseous helium 42. Valve 68 will be opened to allow liquid helium to cool the cryosurfaces 12 and 21. As required, valve 73 will be opened to vent the cryogenic tubes conduits 13 and upper manfold 47 of unwanted gas or pressure. Pumping may be resumed on the freshly cleared cryosurfaces 12 and 21.

Housed within the vacuum vessel 51 of FIG. 4 are depicted two separate cryogenic pumping units 43 and 44. Unit 43 is depicted in the rotatable louvre 32 open position and unit 44 is shown with the louvres 32 closed. It is thus demonstrated that cryopumping may be conducted continuously within the vacuum vessel 51 without the need to intrude the vacuum vessel shell 50 or cease operations within the vacuum vessel 51. Depending upon the size and needs of the system, any number of cryopumping units such as 43 and 44 may be included within the vacuum vessel 51 and synchronously operated.

The invention has thus provided an enhanced cryogenic pumping apparatus, incorporating an improved coolant to surface communication, an efficient pump chamber geometry, the use of an adsorbent spray, and effective thermal shielding with a continuous operation design to achieve continuous, high efficiency cryopumping. Any number of cryopumping chambers may be placed within a given vacuum vessel, such as a fusion reactor, in order to fit the needs of a given system. Further, the system may be expanded by placing more than three tubular cryopanels across individual pump cells in order to increase cryosurface area without using as much additional vaccuum vessel space. The basic cryopump design may be used without the rotatable louvres if continuous operation is not necessary.

What is claimed is:

1. In a cryogenic pumping means including at least one cryopumping cell having cryogenic surfaces, the improvement comprising:

at least one hollow member which is open at each end and constructed of a thermally conductive material, each end of which is adapted to be in controlled communication with an associated reservoir;

an interior surface of said hollow member being adapted to form a conduit between an associated reservoir through which an associated cryogenic coolant is adapted to be passed and;

an exterior surface of said hollow member adapted to being exposed to an associated space to be cryogenically pumped for the entrapment by condensation of gas particles which come into contact with said exterior surface.

2. The improvement of claim 1, comprising:

a plurality of said hollow members which are positioned in parallel and adjacent to one another, each end of each hollow member being in fluid communication with a manifold, said manifolds being in controlled fluid communication with associated reservoirs such that an associated cryogenic coolant is adapted to be passed from an associated reservoir through a manifold at one end of said hollow members, through said hollow members allowing for cooling of the surfaces thereof, through a manifold at another end of said hollow members, and then to another associated reservoir, said manifolds further being entirely enveloped within a common impervious shrouding about at least a portion of each of said hollow members, said shrouding further comprising ports to enable transfer of associated cryogenic fluid through said manifolds between said hollow members and said reservoirs but to prevent communication between said manifolds and any liquid, gas, or solid not within said shrouding.

3. The improvement of claim 2 additionally comprising an apparatus to inject, in a controlled manner, an adsorbent gas, said apparatus comprising:

a thermally conductive plate tangentially connecting adjacent hollow members so that a primary cryopumping pumping space is enclosed on two sides by said hollow members, and on one side by said connecting plate, and open on the remaining side, a surface of said connecting plate being exposed to said space to be cryogenically pumped, a hollow shaft which is in controlled communication with an adsorbent gas and positioned in parallel with said hollow members and centered on a line tangential to the said adjacent hollow members on the open side of said primary cryopumping space opposite the said connecting plate, said hollow shaft further being equipped with equally spaced spray ports on the side facing said primary cryopumping space allowing said adsorbent gas to be sprayed throughout, but not beyond of said primary cryopumping space, and onto surfaces defining said primary cryopumping space, said hollow shaft hereinafter called spray shaft, said shrouding further being adapted with ports to allow passage of said absorbent gas from an associated reservoir to said spray shafts.

4. The improvement of claim 3, comprising:

a plurality of adjacent said hollow members tangentially interconnected on one side by said thermally conductive plates such that a plurality of adjacent primary cryopumping spaces are defined, a single said spray shaft in controlled communication with an adsorbent gas positioned such that its spray path includes said surfaces of each said adjacent primary cryopumping space and is confined to the pluralty of adjacent primary cryopumping spaces, said shrouding being further adapted to envelope a plurality of said manifolds located at each common end of the plurality of said hollow members within a common shroud.

5. The invention of claim 4, further comprising:

a plurality of said spray shafts in controlled communication with a reservoir of adsorbent gas positioned such that their cumulative spray paths cover said surfaces of each said primary cryopumping space and are confined to said plurality of adjacent cryopumping spaces, said shrouding being further adapted with ports to allow passage of a plurality of means supplying said spray shafts with said adsorbent gas from an associated reservoirs.

6. The invention of claim 5 further comprising:

a thermally conductive panel configured in the shape of a shallow V and positioned such that the wings of said V surround said plurality of adjacent hollow members and said plurality of spray by extending from an apex positioned opposite said plurality of spray shafts from said plurality of primary cryopumping spaces out to points beyond said plurality primary cryopumping spaces such that line of sight thermal radiation from any point beyond said thermally conductive panel into said plurality of primary cryopumping spaces is blocked off, said thermally conductive panel further comprising a conduit throughout its interior which is in controlled communication with an associated reservoir of an associated cryogenic coolant which is adapted to pass through said conduit, said shrouding being adapted with ports to allow passage of an associated duct supplying said conduit with cryogenic coolant, said thermally conductive panels further comprising exterior surfaces blackened with a material of high emissivity, said V shaped thermal panel hereinafter referred to as said thermal shield, and said plurality of primary cryopumping spaces as surrounded by said thermal shield hereinafter referred to as said multi-cryopump cell.

7. The invention of claim 6 further comprising;

two or more identical said multi-cryopump cells arranged in a column such that each said thermal shield points in the same direction and said wings therminate in tips which are equally spaced in lines down each side of said column, a thermally conductive louvre pivotably mounted to each said wing tip, said louvre being the equal length of said thermal shield and of width no less than the space between said wing tips, said louvres further being operably interconnected down each side of said column and capable of uniform rotation from an open position in which each said multi-cryopump cell is in maximum gas flow communication with an associated surrounding space to a closed position in which said louvres make seal contact with each said adjacent wing tip down its entire length and with said impervious shrouding across its breadth such that each multi-cryopump cell is closed off from gas flow communication with the surrounding space, a means for warming said hollow members to a temperature sufficient to boil off adsorbent and condensate trapped on its surface, an exhaust means comprising a duct which establishes controlled communication between said cryopump cell and an associated space beyond space to be pumped, said shrouding further being adapted with ports to allow passage of said exhaust duct through the space immediately surrounding said manifolds and further adapted to house the plurality of manifolds at each common end of said multi-cryopump cells, and said louvres further comprising exterior surfaces blackened with a material of high emissivity.

8. A continuous operation cryopump system comprising:

at least two of the regenerative cryopump apparatus as described in claim 7 further comprising, a timing means such that one said regenerative cryopump apparatus may be placed in a condition such that said louvres are closed, said hollow members are warmed, said adsorbent spray shafts are closed, and said exhaust duct is opened to said space beyond said space to be pumped while remaining said regenerative cryopumping apparatus are placed in a condition wherein said louvres are open, said hollow members are cooled with a cryogenic coolant and said adsorbent gas is sprayed within aid primary cryopumping spaces and said exhaust ducts are closed to any space beyond said space to be pumped.

9. The invention of claim 3 further comprising:

a thermally conductive panel configured in the shape of a shallow V and positioned such that the wings of said V shaped thermally conductive panel surround said primary cryopumping space and spray shafts by extending from an apex positioned opposite said spray shaft from said primary cryopumping space out to points beyond said primary cryopumping space such that line of sight radiation from any point beyond said thermally conductive panel into said primary cryopumping space is blocked off, said thermally conductive panel further comprising a conduit throughout its interior which is in controlled communication with an associated reservoir of an associated cryogenic coolant which is adapted to pass through said conduit, said shrouding further being adapted with ports to allow passage of an associated duct supplying said conduit with cryogenic coolant, said thermally conductive panels further comprising exterior surfaces blackened with a material of high emissivity, said V shaped thermal panel hereinafter referred to as said thermal shield, and said primary cryopumping space as surrounded by said thermal shield hereinafter referred to as said cryopump cell.

10. The invention of claim 9 further comprising:

at least two identical said cryopump cells arranged in a column such that each said thermal shield points in the same direction and said wings terminate in tips which are equally spaced in lines down each side of said column, thermally conductive louvres, pivotally mounted to each said wing tip, said louvre being the equal length of said thermal shield and of width no less than the space between said wing tips, said louvres further being operably interconnected down each side of said column and capable of uniform rotation from an open position in which each said cryopump cell is in maximum gas flow communication with an associated surrounding space to a closed position in which said louvres makes seal contact with each said adjacent wing tip down its entire length and with said impervious shrouding across its breadth such that each cryopump cell is closed off from gas flow communication with the surrounding space, a means for warming said hollow members to a temperature sufficient to boil off adsorbent and condensate trapped on its surface for exhausting said cryopump cell comprising a duct which establishes controlled communication between said cryopump cell and an associated space beyond said vacuum vessel, said shrouding further being adapted with ports to allow passage of said exhaust duct through the space immediately surrounding said manifolds and further adapted to house the plurality of manifolds at each common end of said cryompump cells, said louvres further comprising exterior surfaces blackened with a material of high emissivity.

11. A continuous operation cryopump system comprising:

at least top of the regenerative cryopump apparatus as described in claim 10, further comprising, a timing means such that one said regenerative cryopump apparatus may be placed in a condition such that said louvres are closed, said hollow members are warmed, said adsorbent spray shafts are closed, and said exhaust duct is opened to said space beyond said space to be pumped while remaining said regenerative cryopumping apparatus are placed in a condition wherein said louvres are open, said hollow members are cooled with a cryogenic coolant and said adsorbent gas is sprayed within said primary cryopumping spaces and said exhaust ducts are closed to any space beyond said space to be pumped.

12. The invention of claim 4, further comprising:

a thermally conductive panel configured in the shape of a shallow V and positioned such that the wings of said V surround said plurality of adjacent hollow member and said spray shafts by extending from an apex positioned opposite said spray shaft from said plurality of primary cryopumping spaces out to points beyond said plurality of primary cryopumping spaces such that line of sight thermal radiation from any point beyond said thermally conductive panels into said plurality of primary cryopumping spaces is blocked off, said thermally conductive panel further comprising a conduit throughout its interior which is in controlled communication with an associated reservoir of an associated cryogenic coolant which is adapted to pass through said conduit, said shrouding being adapted with ports to allow passage of an associated duct supplying said conduit with cryogenic coolant and to house the plurality of manifolds at each common end of said hollow members within a common said shroud, said thermally conductive panels further comprising exterior surfaces blackened with a material of high emissivity, said V shaped thermal panel hereinafter referred to as said thermal shield and said primary cryopumping spaces as surrounded by said thermal shield hereinafter referred to as said multi-cryopump cell.

13. The invention of claim 12, further comprising:

two or more identical said multi-cryopump cells arranged in a column such that each said thermal shield points in the same direction and said wings terminate in tips which are equally spaced in lines down each side of said column, a thermally conductive louvre pivotally mounted to each said wing tip, said louvre being the equal length of said thermal shield and of width no less than the space between said wing tips, said louvres further being operably interconnected down each side of said column and capable of uniform rotation from an open position in which each said cryopump cell is in maximum gas flow communication with an associated surrounding space to a closed position in which said louvres make contact with each said adjacent wing tip down its entire length and with said impervious shrouding across its breadth such that each multi-cryopump cell is closed off from gas flow communication with the surrounding space, a means for warming said hollow members to a temperature sufficient to boil off any absorbent and condensate trapped on its surface, an exhaust means comprising a duct which establishes controlled communication between said cryopump cell and an associated space beyond space to be pumped, said shrouding further being adapted with ports to allow passage of said exhaust duct through the space immediately surrounding said manifolds and further adapted to house the plurality of manifolds at each common end of said multi-cryopump cells.

said louvres further comprising exterior surfaces blackened with a material of high emissivity.

14. A continuous operation cryopump system comprising:

at least two the regenerative cryopump apparatus as described in claim 13 further comprising, a timing means such that one said regenerative cryopump apparatus may be placed in a condition such that said louvres are closed, said hollow members are warmed, said absorbent spray shafts are closed, and said exhaust duct is opened to said space beyond said space to be pumped while remaining said regenerative cryopumping apparatus are placed in a condition wherein said louvres are open, said hollow members are cooled with a cryogenic coolant and said adsorbent gas is sprayed within said primary cryopumping spaces and said exhaust ducts are closed to any space beyond said space to be pumped.

15. A method for creating and maintaining a virtual vacuum within an enclosed space comprising the steps of;

suction pumping an enclosed space to the capacity of the suction pump and then isolating the suction pump from the enclosed space;

providing cells within the enclosed space for housing cryogenically cooled surfaces, the cells being shielded from surrounding radiant heat but in fluid communication with the enclosed space;

projecting an adsorbent gas throughout the cells and onto the cryogenically cooled surfaces such that stray gas particles within the cell are adsorbed by the adsorbent gas and trapped on the cryogenically cooled surfaces, isolating the cells from the the enclosed space and warming the surfaces therein to allow the trapped gas particles to boil off of the surfaces and be liberated throughout the cell, and exhausting the trapped particles from the isolated cell to an associated space beyond the enclosed space.

16. The improvement of the method of claim 15, additionally comprising the step of, synchronizing a plurality of apparatus within a common enclosed space such that at least one apparatus continuously exposes the cells to the enclosed space.

17. An apparatus for conducting regenerative cryopumping, said means comprising:

a plurality of cryopump cells comprising cryogenic surfaces further comprising a plurality of hollow members which are shielded from the surrounding radiant heat but in fluid communication with an associated enclosed space, means for cooling said surfaces comprising a reservoir of a cryogenic coolant in fluid communication with the interior of said hollow members, means for injecting an adsorbent gas throughout said cells and onto said cryogenic surfaces comprising a hollow shaft equipped with spray ports directing said adsorbent gas onto said cryogenic surfaces so that gas particles coming into contact with said adsorbent gas will adhere thereto and be delivered to and frozen upon said cryogenic surfaces, means for isolating said cryopump cells from said enclosed space comprising impervious shrouding surrounding the ends and faces of said cryopump cells cooperating with louvres along the sides of said cryopump cells such that said louvres may be rotated closed to achieve isolation, means for warming said isolated cryopump cells in order to liberate said trapped gas particles comprising a reservoir of a pressurized gas which is in controlled fluid communication with the interior of said hollow members, and means for exhausting said liberated gas particles from within said isolated cryopump cell to a point beyond said enclosed space.

18. The invention of claim 17 wherein said hollow members are shielded from the surrounding radiant heat by contoured panels roughly surrounding one side of said hollow members, a conduit within said contoured panels being in fluid communication with a cryogenic coolant, and surfaces of said contoured panels being blackened with a material of high emissivity.

19. The invention of claim 18 wherein said adsorbent gas is argon.

20. The invention of claim 19 wherein, said cryogenic coolant within said hollow members is liquid helium, wherein said pressurized gas warming said hollow members is gaseous helium, and wherein said cryogenic coolant within said contoured panels is liquid nitrogen.

* * * * *